United States Patent [19]

Sato et al.

[11] Patent Number: 4,697,912

[45] Date of Patent: Oct. 6, 1987

[54] PROCESS HEAD FOR ELECTROPHOTOGRAPHIC APPARATUS

[75] Inventors: Yoshimitsu Sato; Shuichi Ohtsuka; Akinori Kimura; Akira Yoda, all of Kanagawa; Keishi Kato; Isoji Takahashi, both of Minami-ashigara, all of Japan

[73] Assignee: Fuji Photo Film Co., Ltd., Kanagawa, Japan

[21] Appl. No.: 885,748

[22] Filed: Jul. 21, 1986

Related U.S. Application Data

[63] Continuation of Ser. No. 585,932, Mar. 5, 1984, abandoned.

[30] Foreign Application Priority Data

Mar. 8, 1983 [JP] Japan ..... 58-36581

[51] Int. Cl.[4] ..... G03G 21/00

[52] U.S. Cl. ..... 355/3 R; 355/7; 355/10; 355/16

[58] Field of Search ..... 355/3 R, 7, 10, 16, 355/54, 64, 65

[56] References Cited

U.S. PATENT DOCUMENTS

| | | | |
|---|---|---|---|
| 3,528,355 | 9/1970 | Blackert | 355/27 |
| 3,964,828 | 6/1976 | Yamada et al. | 355/10 |
| 3,972,610 | 8/1976 | Gross | 355/64 |

*Primary Examiner*—Arthur T. Grimley
*Assistant Examiner*—David Warren

[57] ABSTRACT

In a process head for electrophotographic apparatus integrally formed with a charing/exposing chamber, a developing chamber, a drying chamber and a fixing chamber along the feeding direction of the film for recording and thereby made capable of processing plural frames of the recording film simultaneously, stage heads which constitute the respective processing chambers are fixed to a mounting member and a portion with charging mechanism is detachably inserted in the interval space between the stage head corresponding to the charging/exposing chamber and the mounting member so that its maintenance can be facilitated and the apparatus as a whole can be made compact in size.

2 Claims, 11 Drawing Figures

PROCESS HEAD FOR ELECTROPHOTOGRAPHIC APPARATUS

This application is a continuation of application Ser. No. 585,932, filed Mar. 5, 1984; this Ser. No. is now abandoned.

BACKGROUND OF THE INVENTION (1) Field of the Invention

The present invention relates to a process head for electrophotographic apparatus for recording picture image data on electrophotosensitive material by processing the same in various stages, i.e. charging/exposing developing, drying and fixing, and more particularly to a process head which is simple in maintenance and compact in size.

(2) Description of the Prior Art

Picture image data is generally recorded on a microfilm or the like by a 5-stage processing which comprises charging, exposing, developing, drying and fixing in a wet-type electrophotograph recording system. In short, a film or an electro-photosensitive material is charged on the surface thereof by corona-discharge in the charging process and forwarded to an exposing process. In the exposing process, picture image data to be recorded is projected and recorded on the film via an optical system as an electrostatic latent image. The film with the electrostatic latent image is fed to a developing process, where a developer is applied on the photosensitive surface thereof, and toner is electrically adhered according to the pattern of the latent image. Then, the film is passed to the drying process to dry unnecessary developer. The toner which has been electrically adhered is fused in a fixing process, thereby recording the picture image data on the film almost permanently. If a special liquid developer is used, it may be dried and fixed simultaneously. In such a case, the drying process includes the fixing process and the film may be finished completely by a 4-stage process.

As it is possible to forward the image recording process by a frame of a film in such an electrophotographic system, it can advantageously reproduce a picture image data immediately. Also, since said electrophotosensitive member is not photosensitive until it is charged, the film can be inserted in daylight and it is more advantageous compared with a conventional recording system using a silver halide photographic material and, therefore, has been applied in various fields.

In the above electrographic recording system, as the toner is electrically adhered to an electro-photosensitive member as described above, it is necessary to immediately fix it. The above processing is, therefore, conducted on each frame consecutively and continuously. There have been proposed various types of recording heads which can conduct image processing in a short time and have processing sections arranged in a space-saving manner.

A conventional head is shown in FIGS. 1(a) and 1(b). The recording head 10 in FIG. 1(a) is provided with a charging/exposing section 11, a fixing section 12 adjacent thereto, a liquid-removing section 13 and a developing section 14, arranged in that order, and all the sections other than the liquid-removing section 13 have openings of a size corresponding to a frame of a film. A frame of the film is uniformly charged and projected with image at the charging/exposing section 11, then passed to the developing section 14 via the fixing section 12 and the liquid-removing section 13 and processed for development. It then is reversed in direction to pass toward the liquid-removing section 13 to remove the liquid and dry while moving toward the fixing section 12. Fixing process is conducted in the section and at the same time a new frame adjacent to the first frame is charged and exposed at the charging/exposing section.

The recording head 20 shown in FIG. 1(b) is an example where a main body 21 is slidably provided in the advancing direction of the film and is comprised of a developing section 22, an exposing section 23, a charging section 24, and a drying section 25 arranged in due order. In the recording head 20, the main body 21 is moved in the advancing direction of the film toward a frame thereof which is held stationary at a predetermined position to conduct processes from charging to developing consecutively by the charging section 24, the exposing section 23, and the developing section 22. Then, the main body 21 is reversed in movement so that the drying section 25 comes to face the frame to conduct drying and fixing operations. As reference materials concerning FIG. 1(a), there are U.S. Pat. No. 3,972,610 and No. 4,082,442, etc. As for FIG. 1(b), there is Jap. Pat. Pub. Sho 54-13786.

The conventional process heads for recording, however, have a common defect. They have a complex feeding mechanism because the relative moving direction of the head must be reversed after developing. Also, it is detrimental efficiency-wise in processing because plural processes can not be conducted simultaneously and the intervals between processes tend to become extended. Further, the process head for recording shown in FIG. 1(a) is detrimental in that since a pressure reducing pump is used for sending the developer into the developing chamber, the structure of the liquid flow system becomes complicated and thus expensive.

SUMMARY OF THE INVENTION

The present invention aims to provide a process head for electrophotographic apparatus for recording picture image data on electro-photosensitive material which is simple in maintenance and compact in size.

In the process head according to the present invention which comprises a charging/exposing chamber, a developing chamber, a drying chamber and a fixing chamber, the process head is characterized in that at least the charging mechanism of the charging/exposing chamber is detachably mounted therein.

Another object of the present invention is to provide a process head which is simpler in maintenance and assembling. The process head comprises a member for mounting and a head member and is characterized in that:

(a) said mounting member is a member to be mounted on an electro-photographic apparatus;

(b) said head member has an opening facing the electro-photosensitive material, and the mounting and the head member are integrally fixed so that a charging/exposing, a developing, a drying and a fixing chambers are formed in the space between the head and the mounting members.

DETAILED DESCRIPTION OF THE INVENTION

In making a recording system of electrophotographs compact, it is important that the charging section which requires maintenance more than others be made easily and detachably mounted without changing the relative position of the lens and the electro-photosensitive material at the time of exposure, and that the space inside the device be utilized to the maximum; to minimize dead space. From the above-mentioned viewpoint, the present invention aims to propose a compact instruction of a process head for electrophotographic apparatus which is capable not only of continuous processing of electrophotographs in a wet type electrophotographic recording system but also of easy repair, inspection and maintenance.

The process head according to the present invention will now be described in detail referring to the accompanying FIGS. 3 through 9.

Figure 4:
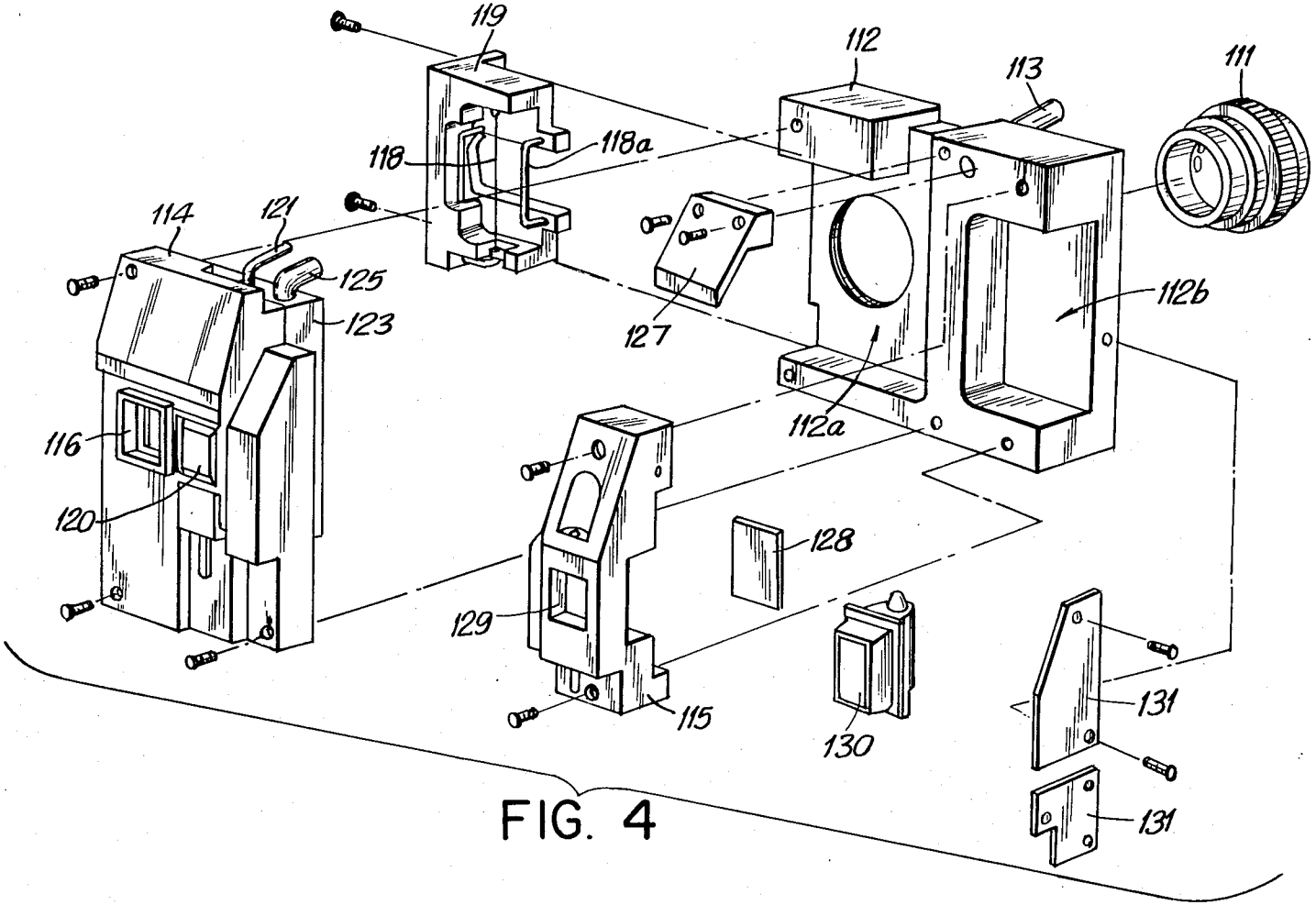
FIG. 4 is an exploded view of one embodiment of the process head according to the present invention.

Referring to FIG. 4 which shows an embodiment in explosion, the process head according to the present invention comprises a mounting member 112 and head members 114 and 115. The mounting member 112 is to be mounted on the main body of an electrophotographic apparatus (not shown), and provided with dented portions 112*a* and 112*b* where each processing chamber will be formed when the head members 114 and 115 are attached thereto. Said dented portions 112*a* and 112*b* are formed on both sides of the mounting member 112 and the mounting member 112 is divided into two sections by these dented portions 112*a* and 112*b*. Further in this embodiment, a lens 111 for exposure or projections is screwed to the dented portion at the left in FIG. 4 and a drying air supply path 113 is formed in said mounting member 112 to blow air for drying onto the electro-photosensitive material located at the drying stage to be described hereinbelow. All the components are to be either screwed or bonded to the mounting member 112.

Said head portions are provided with openings for the respective processing chamber to constitute a charging/exposing window 116, a developing window 120 and a fixing window 129 which face the electro-photosensitive material. These openings in the charging/exposing chamber, developing chamber, drying chamber and fixing chamber respectively are identical in size with one frame of electro-photosensitive material and are arranged in a row starting from the charging-/exposing chamber in said order. The head members in this embodiment comprise a complex stage head 114 which includes portions for the charging/exposing stage, the developing stage and the drying stage, and a single stage head member 115 which is responsible only for the fixing stage. The construction of the head is not limited to the one mentioned above but may be different so long as at least two or more stage heads respectively having said processing chambers are formed and arranged in a row.

Figure 1A:
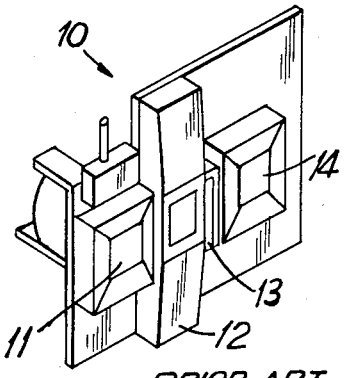
PRIOR ART FIG. 1(a)
FIGS. 1(a) and 1(b) show perspective views of a prior art process head for electrophotographic apparatus.
Figure 2:
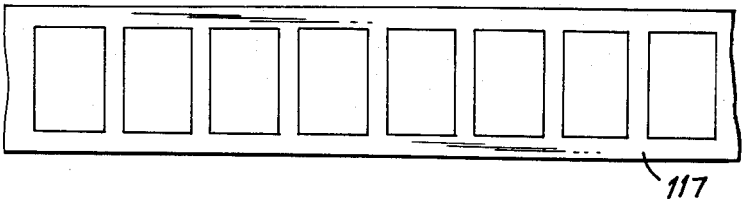
FIGS. 2(a) and 2(b) are schematic views to show the electro-photosensitive material, i.e. film, to be used in the present invention.
Figure 2B:
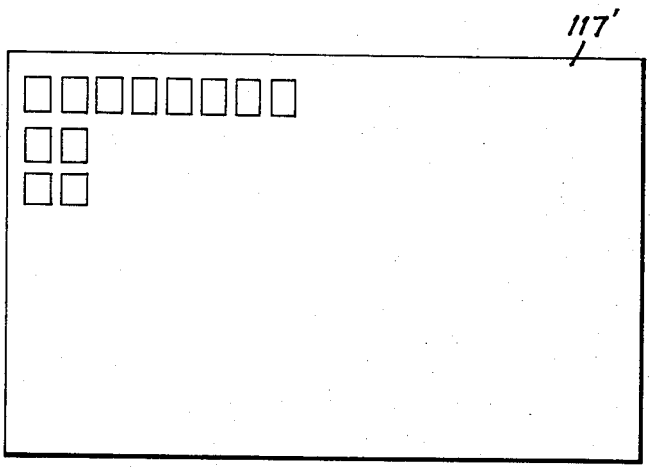
Figure 1B:
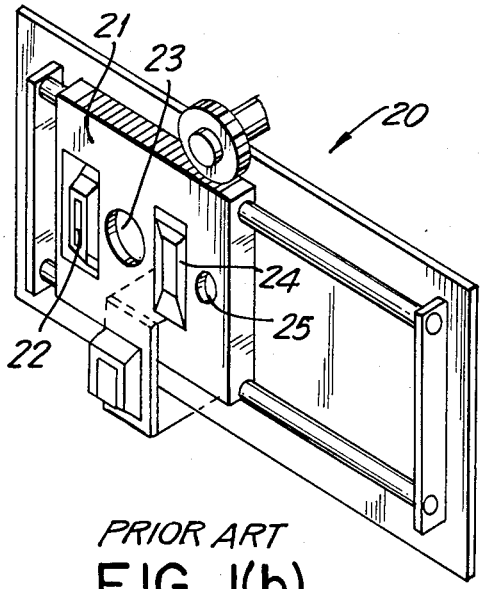
PRIOR ART FIG. 1(b)
Figure 3:
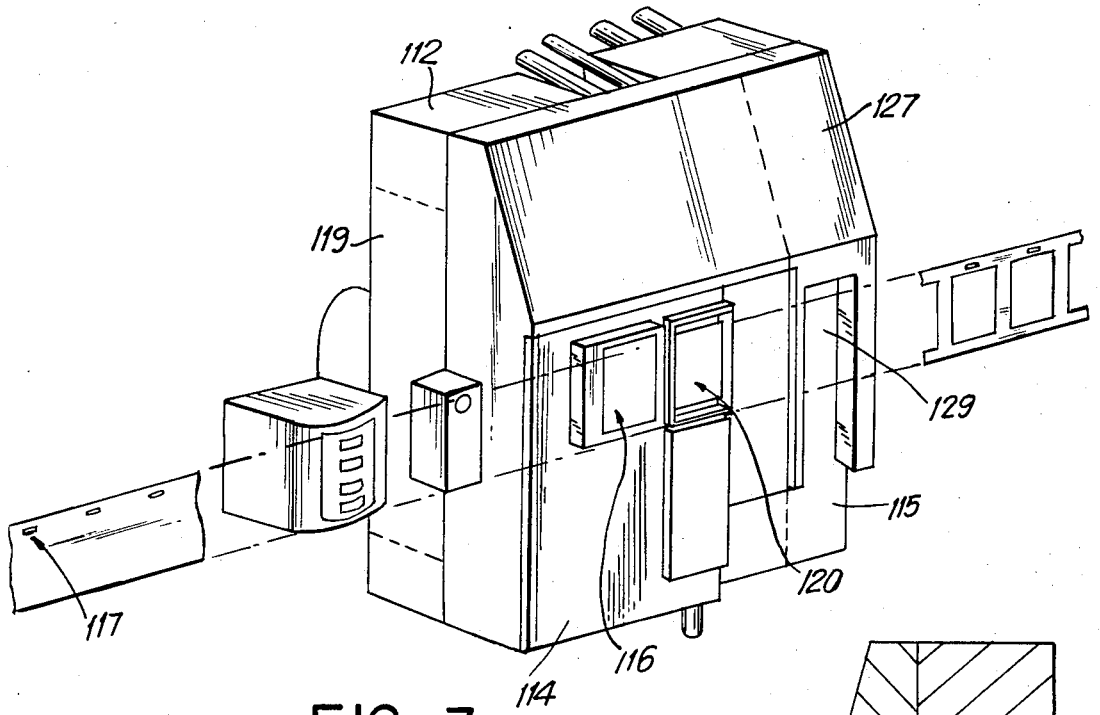
FIG. 3 shows one embodiment of the process head according to the present invention.
Figure 5:
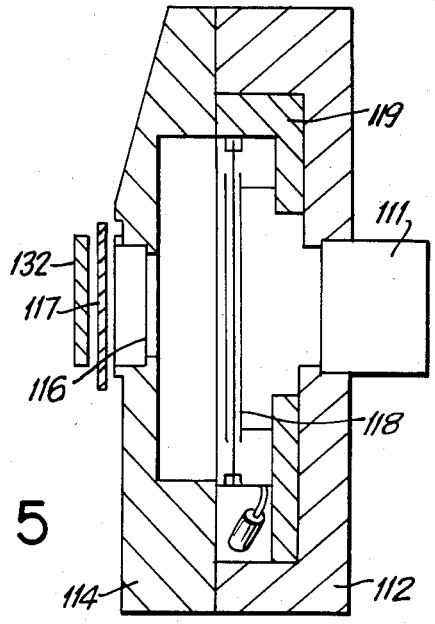
FIG. 5 shows a portion of the charging/exposing stage in section.

The construction of the charging/exposing stage in section is shown in FIG. 5. As is shown, the charging-/exposing window 116 is formed in the complex stage head 114 at its charging/exposing stage to oppose the lens 111. A detachable charging head 119 which opposes the electro-photosensitive material 117 and which is provided with a corona wire 118 for charging said material fits in the mounting member 112 in a manner to be held between the mounting member 112 and the complex stage head 114. Although the charging mechanism shown in this embodiment comprising the corona wire 118 and corona electrodes 118*a* on both sides of the wire is made detachable, any form of mechanism may be used so long as the corona wire 118 is detachable.

The configuration of the mounting member 112 and the charging head 119 is not limited to the one shown in the above embodiment so long as the charging head 119 can be attached to the mounting member 112 as complex stage head 114 is assembled to the member 112.

Figure 6:
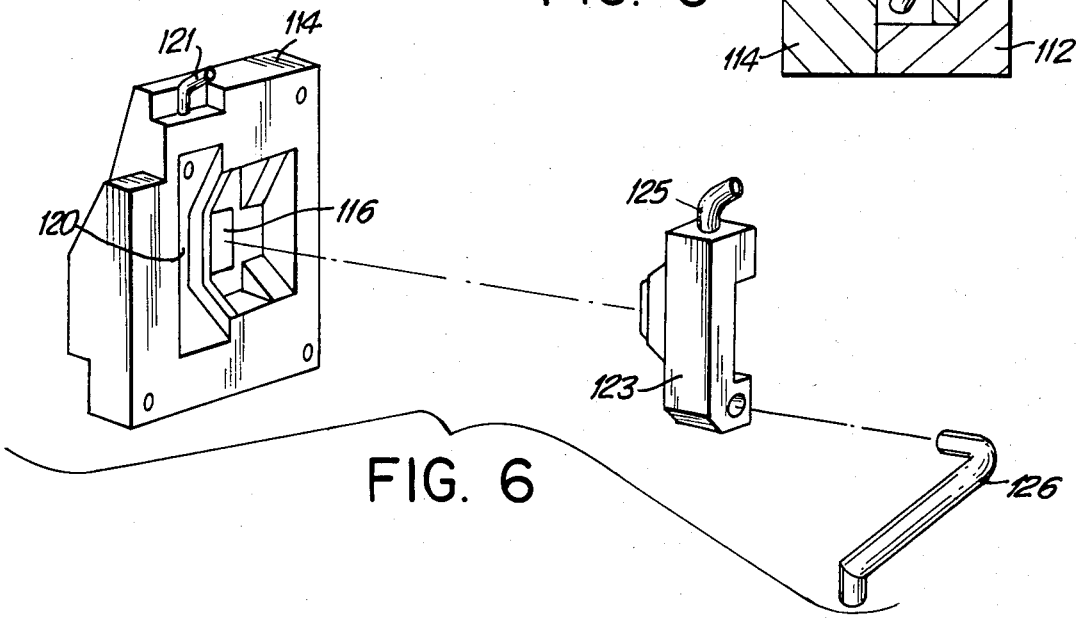
FIG. 6 is a perspective exploded view to show the back of the head for plural stages.
Figures 7, 8, 9:
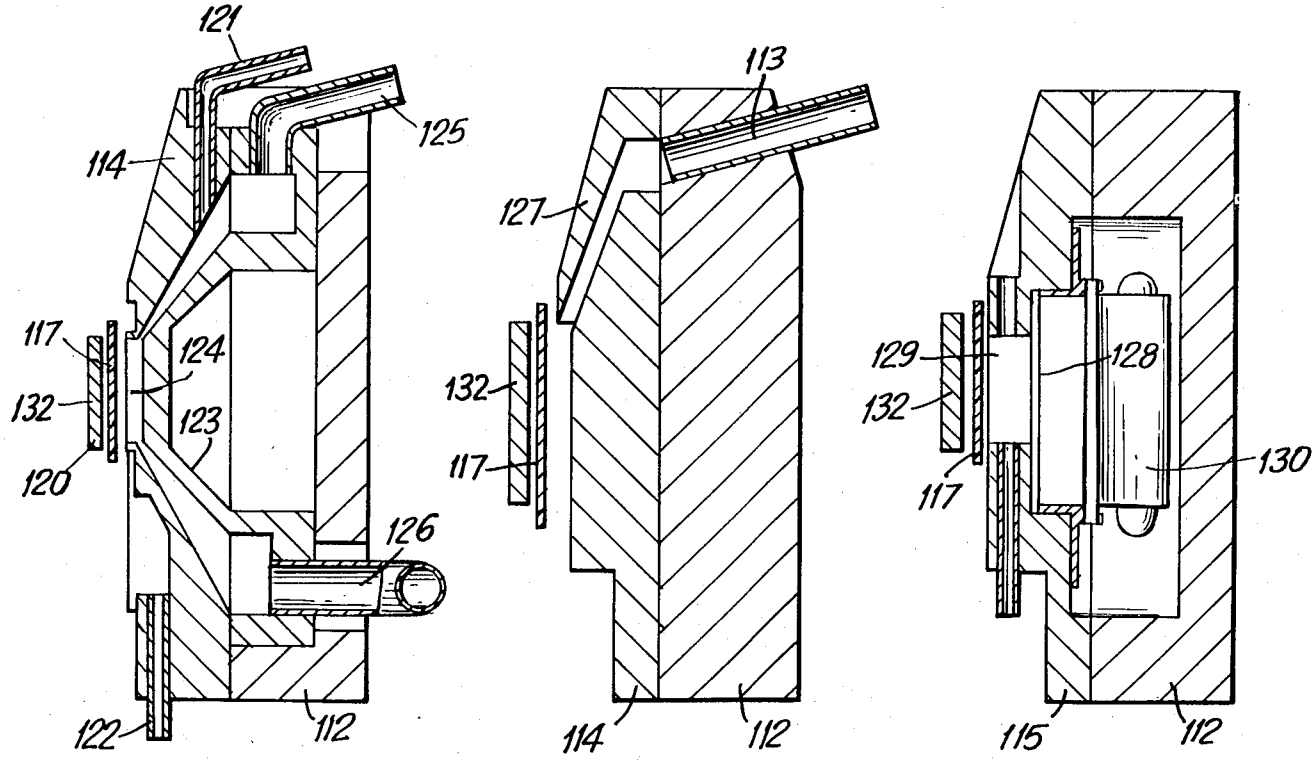
FIG. 7 is a sectional view of a portion of the developing stage.
FIG. 8 is a sectional view of a portion of the drying stage.
FIG. 9 is a sectional view of a portion of the fixing stage.

Referring now to FIG. 6 which shows the back of the complex stage head 114 in explosion and FIG. 7 which shows the sectional view of the developing stage, the complex stage head 114 is formed with a developing window 120 adjacent to the charging/exposing window 116. A developer supply path 121 is provided above the window 120 and a suction path 122 is provided below the window 120 to remove excess developer remaining on the surface of the electro-photosensitive material 117 after developing. A partition 123 which projects toward the developing window 120 is integrally fixed by adhesion or fusion to the back of the complex stage head 114 at the developing stage. The developing chamber 124 is formed between said partition 123 and the developing window 120. The partition 123 is provided with a squeezing-air supply path 125 and a discharge path 126 for discharging excess developer and squeezing air. Thus, the developer supplied via the developer supply path 121 or the air blown via the air supply path 125 flows through the developing chamber 124 and goes out from the discharge path 126. At the drying stage (FIG. 8), drying air supplied from the drying air supply path 113 is blown on the electro-photosensitive material 117 positioned at this portion. As shown in FIG. 8 in section, a guide plate 127 is screwed to the mounting member 112 to guide the drying air from the air supply path 113 toward the electro-photosensitive material 117. As shown in FIG. 9, which is the sectional view of the fixing stage, a window for fixing 129 having a protective glass 128 pasted thereon is formed in the single stage head 115 which is screwed to the mounting member 112. A detachable Xenon flash light tube 130 is inserted between the single stage head 115 and the mounting member 112 and shielded from outside by means of a pair of shielding plates 131 (FIG. 4) which are screwed to the mounting member 112 and the single stage head 115. Although the complex stage head 114 and the single stage head 115 are provided separately in this embodiment, they can be manufactured as an integral component. It is also noted that any known means for charging, drying or fixing other than those employed in this embodiment can be used. In the embodiment, a press plate 132 is provided at each stage to retain the electro-photosensitive material 117 flat.

The device operates in the same manner as the conventional device for recording data. The charging/exposing stage, developing stage, drying stage and fixing stage are located in this order at an interval corresponding to one frame of the electro-photosensitive material 117, and the electro-photosensitive material 117 moves forward intermittently frame by frame so that necessary picture image data are consecutively recorded on the material 117 (or 117'). The charging head 119 which requires inspection/maintenance and repair/placement due to failure can be easily detached from the mounting member 112 by removing the screws. Likewise, the Xenon flash light tube 130 can also be easily detached. There is no risk of varying the distance between the lens 111 and the electro-photosensitive material 117 in operation and thus there is less risk of lowering the precision by attaching/detaching the charging head 119. A large space is formed at the back of the developing chamber 124, where the portion of the charging head 119 which holds the corona wire can be installed so as to minimize the interval made between the charging/exposing stage and the developing stage, thereby making the head compact as a whole.

As has been described above, since the charging section can be separately attached/detached arbitrarily in the process head according to the present invention, inspection, maintenance or repair thereof can be done promptly as well as easily.

What is claimed is:

1. A processing head for attachment to an electrophotographic apparatus, said processing head comprising adjacent to each other a charging/exposing chamber, a developing chamber, a drying chamber, and a fixing chamber, for recording picture images on electrophotosensitive material, said chambers being respectively provided with windows facing said electrophotosensitive material, said chambers being arranged in a row in the following order: charging/exposing chamber, developing chamber, drying chamber, and fixing chamber in the direction of movement of said electro-photosensitive material, the windows being spaced apart at intervals corresponding to the length of a frame of a picture image formed on said electrophotosensitive material, said charging/exposing chamber comprising charging means inside thereof including a member having fixed thereto a corona wire for charging a picture image area on said electro-photosensitive material, said corona wire being positioned at the center of said electro-photosensitive material facing said window of said charging/exposing chamber and being straightly stretched with both ends thereof fixed to said member so that said corona wire is parallel to a surface of said electro-photosensitive material, said charging/exposing chamber being located in the optical path of the picture image light for exposing said electrophotosensitive material so that picture image light focusing on said electro-photosensitive material is positioned abuttingly on said charging/exposing window for creating on a surface of the material an electro-static latent image, said developing chamber having a space with an opening for facing said surface and for developing said electro-static latent image by developer supplied to said space; said drying chamber having means for applying air to said electro-photosensitive material to dry the developer; said fixing chamber comprising fixing means for fixing a toner picture image formed on the electro-photosensitive material; at least said member of the charging/exposing chamber where said corona wire is fixed being detachably mounted to said head without changing the position of said charging/exposing window in said light path.

2. A processing head as claimed in claim 1, comprising a mounting member having means for attachment to an electrophotographic apparatus; and a head member having an opening for facing the electrophoto-sensitive material, said mounting member and said head member being fixed to each other, and a space between said two members forming said charging/exposing chamber, developing chamber, drying chamber, and fixing chamber.

* * * * *